US007627974B2

(12) United States Patent
Olson

(10) Patent No.: US 7,627,974 B2
(45) Date of Patent: Dec. 8, 2009

(54) BRIDGED EXTRACTOR SPRING FOR FIREARMS

(75) Inventor: Douglas Dean Olson, Huntsville, AR (US)

(73) Assignee: Wilsons Gunshop Inc, Berryville, AR (US)

( * ) Notice: Subject to any disclaimer, the term of this patent is extended or adjusted under 35 U.S.C. 154(b) by 220 days.

(21) Appl. No.: 11/713,066

(22) Filed: Mar. 2, 2007

(65) Prior Publication Data

US 2008/0209788 A1 Sep. 4, 2008

(51) Int. Cl.
*F41A 15/00* (2006.01)

(52) U.S. Cl. ..... 42/46; 42/25; 89/185

(58) Field of Classification Search ..... 42/16, 42/46, 25; D22/108; 89/185
See application file for complete search history.

(56) References Cited

U.S. PATENT DOCUMENTS

| | | | | |
|---|---|---|---|---|
| 5,911,173 | A * | 6/1999 | Westrom | 89/185 |
| 5,974,716 | A | 11/1999 | Kidd | |
| 6,044,748 | A * | 4/2000 | Westrom | 89/185 |
| 6,182,389 | B1 | 2/2001 | Lewis | |
| 6,609,319 | B1 | 8/2003 | Olson | |
| 2008/0092733 | A1 * | 4/2008 | Leitner-Wise et al. | 89/138 |

* cited by examiner

*Primary Examiner*—Michael Carone
*Assistant Examiner*—Benjamin P Lee

(57) ABSTRACT

New and unique improvements of prior known M4/M16 firearms are disclosed that comprise (A) a bolt which, in addition to all of the normal M4/M16 features is configured or reconfigured to accept a bridged extractor spring which straddles the firing pin and presses against the bottom of the extractor with the bridging wire, and (B) a bridged extractor spring which is a single part, wound with dual spaced helical coils connected with a bridge wire that maintains the spacing at the top of the spring. The bridge wire preferably crosses diagonally between and is tangent to both coils.

2 Claims, 3 Drawing Sheets

BRIDGED EXTRACTOR SPRING FOR FIREARMS

BACKGROUND OF THE INVENTION

1. Field of the Invention

This application relates broadly to extractor mechanisms for firearms. More particularly, it concerns an improved form of extractor spring and the recess in the bolt that houses it for M4/M16 and other military automatic and semi-automatic firearms.

2. Description of the Prior Art

The ubiquitous M4/M16 firearms were designed with an extractor that is powered by a common helical compression spring that has one large loop that has an interference fit into a recess in the extractor. This spring sits well aft of the extractor pivot pin with the loose end of the sprint resting on a shelf above the firing pin. This spring is exposed to such high stresses during operation that in a very small number of cycles the spring is too weak to reliably extract all expended cartridge cases from the chamber of the weapon. This malfunction is known as a "failure to extract". The short service life of the extractor spring has been the object of several redesign efforts. The U.S. military currently utilizes a spring with a rubber core added so that to the spring force is added the force required to deform the rubber with the resultant additive force being sufficient to extend the service life for an additional period of time. Unfortunately the effective spring rate of the rubber material is sensitive to the environmental temperatures so that the total force applied to the extractor varies considerably with ambient temperature. The rubber piece is also in intimate contact with the spring and grit from the environment can lodge into the rubber and act to abrade the spring wire as the weapon fires, thus prematurely weakening the spring. Lewis in U.S. Pat. No. 6,182,389 and Olson in U.S. Pat. No. 6,609,319 both described new bolt designs for the M4/M16 that solve the extractor spring failure problem by changing the extractor design and having two helical compression springs that fit beside the firing pin so that spring stresses can be reduced. The problem with both of these designs is that they require changing the complete bolt and barrel assemblies in the weapon in order to incorporate the alteration. Currently users of M4/M16 rifles attempt to replace the extractor springs at an interval which is considerably less than the actual average extractor spring life. This requires that the operators of these weapons keep track of the quantity of rounds fired so their weapon does not start experiencing "failure to extract" malfunctions before the extractor spring is replaced.

The present invention solves the extractor spring life issue by allowing a relatively simple modification to the bolt whereby a pocket is created that accepts a specially designed bridged extractor spring that works with the weapon's original, unmodified extractor. The pocket allows the bridged spring to straddle the firing pin so that there is sufficient spring length to maintain a proper force against the extractor without resulting in excessive torsional stress within the spring. A portion of the pocket beneath the bridge wire is also removed from the bolt so the bridge wire can fit between the extractor and the bolt. The bridge wire fits under the extractor and allows the standard extractor to properly depress the bridged spring coils as the weapon is cycled. The bridged extractor spring cannot be installed incorrectly as its design is symmetrical about the center line of the extractor and the bridge prevents inverting the spring.

OBJECTS

A principal object of the invention is to provide the operator with a bolt and extractor assembly with a dramatically reduced rate of "failure to extract" malfunctions due to weak extractor springs. The "failure to extract" malfunction rate is directly related to the amount of force the extractor spring can apply to the extractor. The bridged extractor spring will provide sufficient extractor force at a reduced level of torsional stress with the result being a much longer service life.

A further object is to allow the current inventory of bolts to be modified to provide a pocket that receives the bridged extractor spring as opposed to requiring new bolt purchase. Additionally, due to the large stockpile of M4/M16 extractors the U.S. military possess, it is highly desirable to utilize standard issue extractors without modification. Thus the change over can be accomplished at Government arsenals with the only purchased part being the bridged extractor spring itself.

Other objects and further scope of applicability of the present invention will become from the detailed descriptions given herein; it should be understood however, that the detailed descriptions, while an indication of preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique improvements of prior known M4/M16 firearms that comprise:

(a) a bolt which, in addition to all of the normal M4/M16 features is configured or reconfigured to accept a bridged extractor spring which straddles the firing pin and presses against the bottom of the extractor with the bridging wire.

(b) abridged extractor spring which is a single part, wound with dual spaced helical coils connected with a bridge wire that maintains the spacing at the top of the spring. The bridge wire preferably crosses diagonally between and is tangent to both coils.

A first unique improvement provided by the invention is a bolt and extractor assembly which experiences fewer "failure to extract" malfunctions due to loss of extractor spring force caused by excessive torsional stress within the extractor spring during operation. The bridged extractor spring will provide equal extractor force at a lower level of torsional stress within the spring.

A second unique improvement is to provide the redundancy of dual extractor springs with a single spring which contains two helical coils and a bridging wire connecting the two coils.

A third unique improvement is the ability to convert existing stocks of bolts to accept the bridged extractor spring. While new bolts would be bought with the changes already incorporated, current stocks could be converted if economically feasible.

A fourth unique improvement is that the usage rate of new bridged extractor springs will be much less than those of the current extractor spring due to its longer service life. That also means that the operator will not have to monitor his usage of the weapon and then change out his extractor spring to assure proper operation of his M4/M16.

BRIEF DESCRIPTION OF THE DRAWINGS

A more complete understanding of the invention can be obtained by reference to the accompanying drawings wherein generic parts of the illustrated matter are indicated by arrowhead lines associated with the designation numerals while specific parts are indicated by plain lines and wherein.

DESCRIPTION OF PREFERRED EMBODIMENTS

Figure 1:
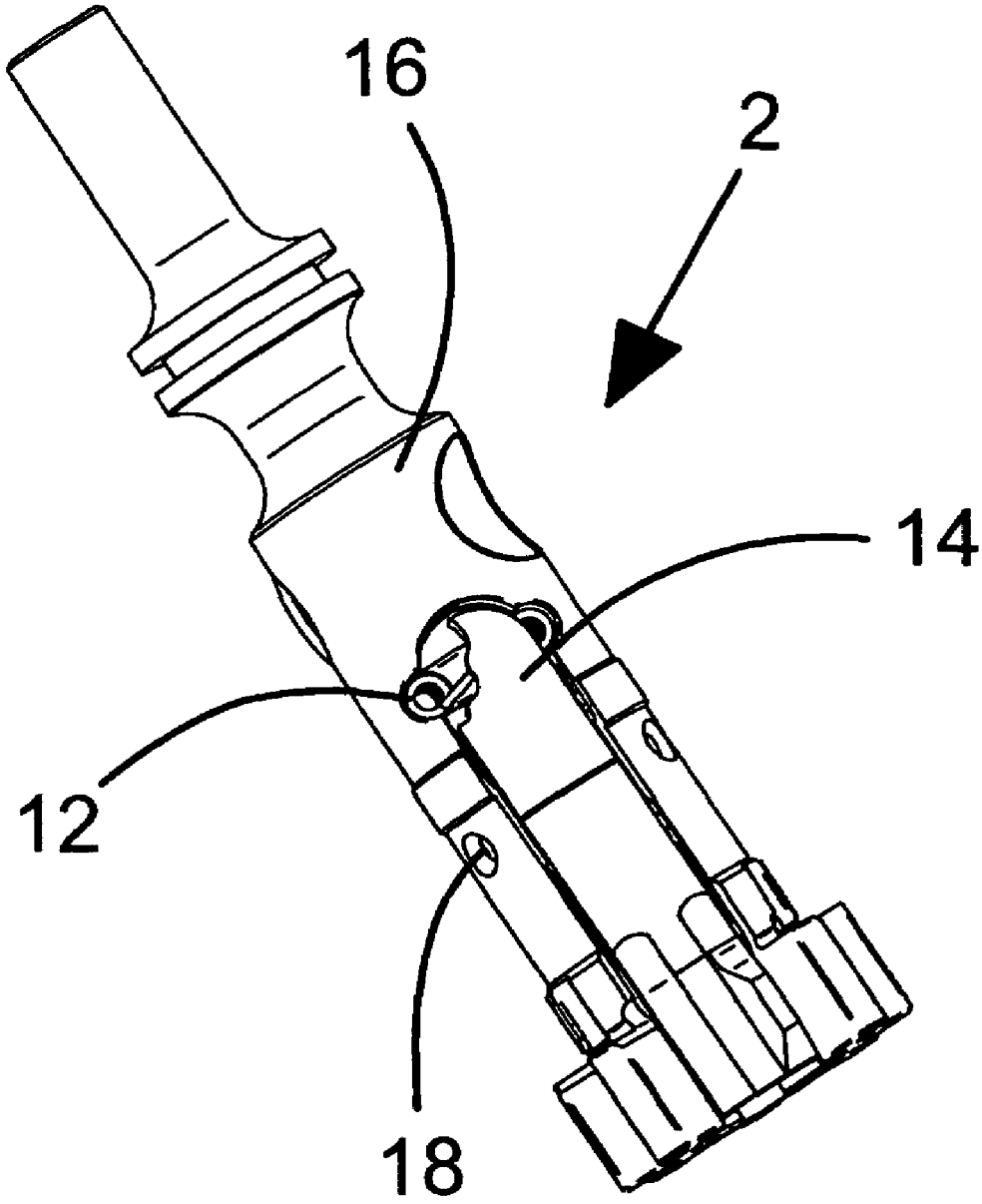
FIG. 1 is an isometric view of the components of a bolt for an M4/M16 firearm with a partial cutaway of the extractor showing the bridged extractor spring.

Referring in detail to FIG. 1 of the drawings, the bolt and extractor assembly 2, consists of a bolt body 16, a bridged extractor spring 12, an extractor 14 and an extractor pivot pin 18.

Figure 2:
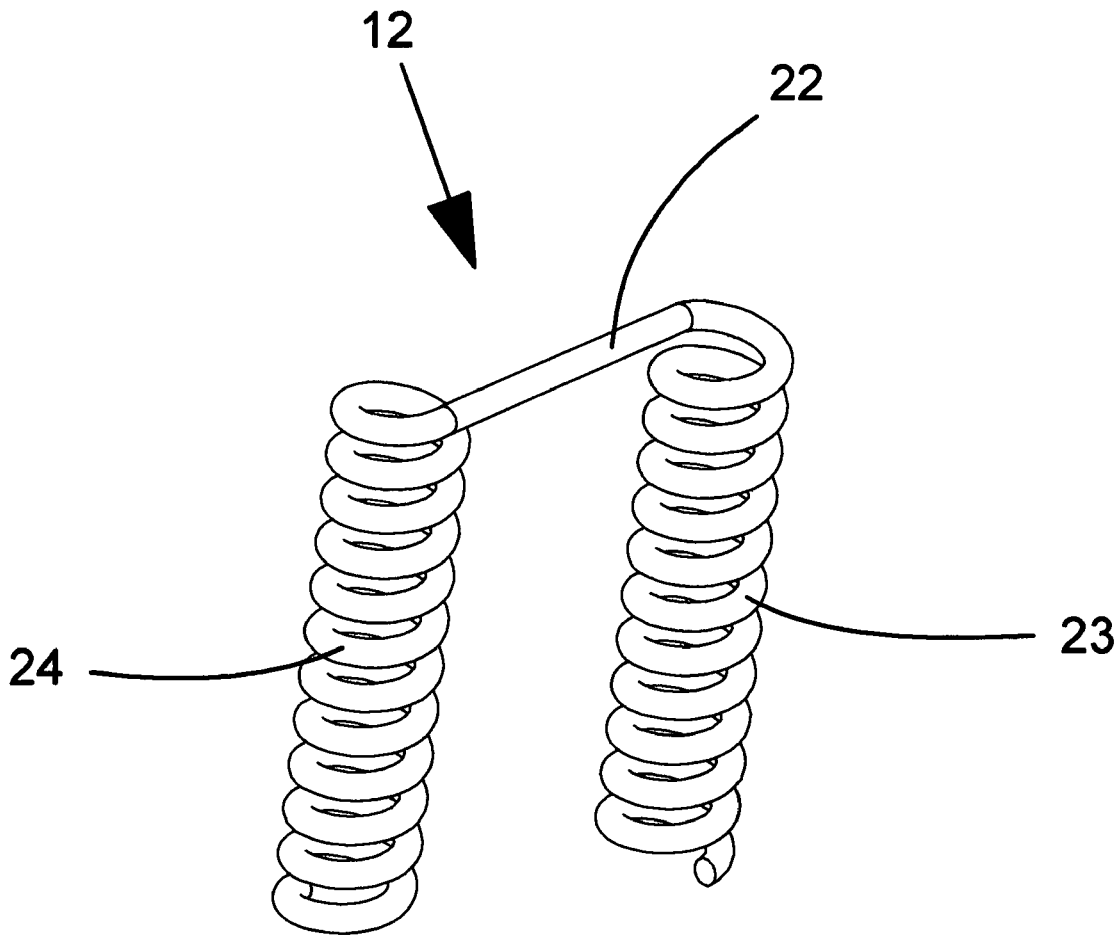
FIG. 2 is an enlarged isometric view of the bridged extractor spring shown in FIG. 1.

Referring to FIG. 2, the bridged extractor spring 12, consists of two helical wound spring coils 23 and 24 connected with bridging wire 22.

Figure 3:
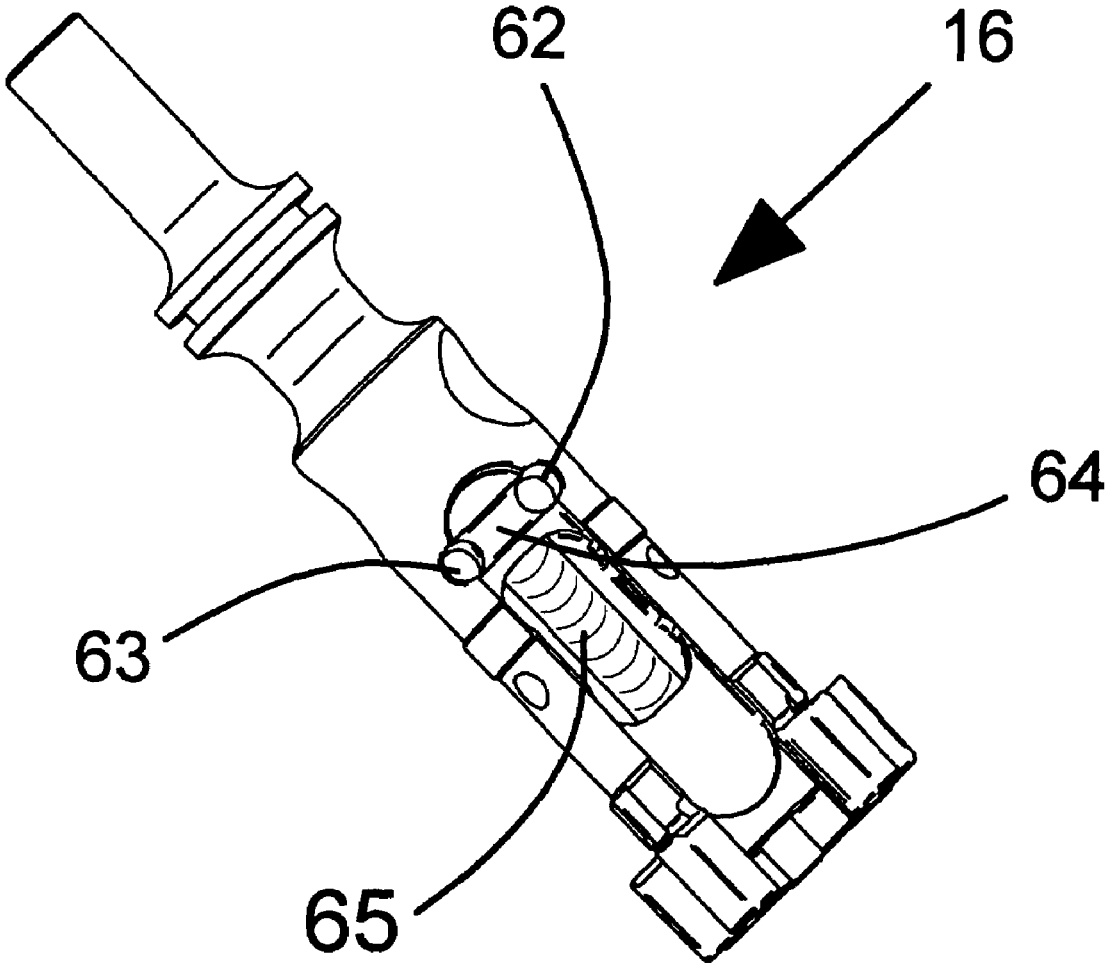
FIG. 3 is an isometric view of the bolt shown in FIG. 1 detailing the three points of modification.

Referring to FIG. 3, the bolt body 16, has been modified by providing spring pockets 62 and 63 which straddle the bore for the firing pin 65. Clearance cut 64 provides the space for the bridging wire 22 to fit beneath the extractor 14 at its maximum angle relative to the bolt body (both not shown for clarity).

The bolt body 16 may be a standard M16 bolt that is re-configured to allow for installation of the bridged extractor spring 12 or it may be a newly manufactured M16 bolt that is pre-configured for installation of the bridged extractor spring 12. If the bolt body is a standard M16 bolt, the modifications to the bolt consist of machining two spring pockets 62 and 63 and a clearance cut 64. The two spring pockets 62 and 63 are positioned so that they straddle the bore for the firing pin 65 and the clearance cut 64 is positioned between the two spring pockets.

Assembly of the extractor to the re-configured M16 or newly manufactured M16 bolt consists of placing the two helical wound spring coils 23 and 24 of the bridged extractor spring 12 into the two spring sockets 62 and 63 with the bridging wire 22 being placed into the clearance cut 64. Due to the symmetrical design of the bridged extractor spring, incorrect assembly or positioning of the bridged extractor spring is not possible, and this is due to the bridging wire 22. As the bridging wire 22 is tangent to the spring coils 23 and 24, it does not matter which way the bridged extractor spring 12 is placed into the bolt 16 as the bridging wire 22 must fit into the clearance cut 64.

The extractor 14 is then placed into the extractor pocket in the bolt 16, with the rear end of the extractor 14 being placed over the bridged extractor spring 12. The extractor pivot pin is then inserted into the pivot pin hole in the bolt, securing the extractor 14 to the bolt 16.

The bridged extractor spring provides a number of advantages over the prior art in that a reduction in "failure to extract" malfunctions is achieved by minimizing the loss of extractor spring force, major alterations to the bolt and barrel assembly are not required as was necessary when previously using dual extractor springs, and redundancy is provided by the use of one spring with two coils and a bridging wire between the two coils. Other advantages include a longer round count before replacement is necessary and an existing M16 bolt may be used with only minor modifications required to allow for the use of the bridged extractor spring.

While the invention has been shown and described with reference to a certain specific preferred embodiment, modification may now suggest itself to those skilled in the art. Such modifications and various changes in form and detail may be made herein without departing from the spirit and scope of the invention. Accordingly, it is understood that the invention will be limited only by the appended claims.

The invention claimed is:

1. A bolt and extractor assembly for a firearm comprising:

(a) a bridged extractor spring which consists of two helical coils and a connecting bridge wire;

(b) a bolt having a firing pin bore disposed in said bolt along a longitudinal axis; an opening in said bolt for receiving an extractor; a pair of spring wells that are disposed around said firing pin bore and a pocket that connects said pair of spring wells; an extractor that resides within said opening in said bolt and said extractor having a proximal end and a distal end, said extractor being pivotably coupled to said bolt; and a firing pin reciprocally carried in said firing pin bore;

(c) said bridged extractor spring being positioned within said pair of spring wells and said pocket connecting said pair of spring wells, and whereby (d) said bridged extractor spring straddles the firing pin and biases said distal end of said extractor towards said bolt face.

2. A bolt and extractor assembly for a firearm of claim 1 where the firearm may be an M4 type Carbine or an M16 type Rifle or a semi-automatic version of said M4 type Carbine or said M16 type Rifle.

* * * * *